US005699218A

United States Patent [19]

Kadah

[11] Patent Number: 5,699,218

[45] Date of Patent: Dec. 16, 1997

[54] SOLID STATE/ELECTROMECHANICAL HYBRID RELAY

[76] Inventor: Andrew S. Kadah, 5000 Hennaberry Rd., Manlius, N.Y. 13104

[21] Appl. No.: 601,212

[22] Filed: Jan. 2, 1996

[51] Int. Cl.[6] ..... H01H 9/30

[52] U.S. Cl. ..... 361/13; 361/8

[58] Field of Search ..... 361/2, 3, 8, 13

[56] References Cited

U.S. PATENT DOCUMENTS

| | | | |
|---|---|---|---|
| 3,474,293 | 10/1969 | Siwko et al. | 361/13 |
| 3,555,353 | 1/1971 | Casson | 361/13 |
| 3,588,605 | 6/1971 | Casson | 361/13 |
| 3,639,808 | 2/1972 | Ritzow | 361/13 |
| 3,860,762 | 1/1975 | Klaiber et al. | 379/189 |
| 4,039,763 | 8/1977 | Angner et al. | 379/30 |
| 4,225,895 | 9/1980 | Hjertman | 361/8 |
| 4,399,391 | 8/1983 | Hammer et al. | 315/244 |
| 4,525,762 | 6/1985 | Norris | 361/13 |
| 4,654,575 | 3/1987 | Castleman | 320/25 |
| 4,760,483 | 7/1988 | Kugelman et al. | 361/13 |
| 4,802,051 | 1/1989 | Kim | 361/13 |
| 5,081,558 | 1/1992 | Mahler | 361/13 |
| 5,283,706 | 2/1994 | Lillemo et al. | 361/3 |

*Primary Examiner*—Jeffrey A. Gaffin
*Assistant Examiner*—Thuy-Trang N. Huynh
*Attorney, Agent, or Firm*—Trapani & Nolldrem

[57] ABSTRACT

A hybrid or combination solid state/electromechanical relay circuit combines the advantageous features of solid state and electromechanical relays but avoids their disadvantageous features. An electromechanical relay includes a coil and a pair of contacts which close in response to energization of the relay coil; this pair of contacts being coupled between the load and the ac source. The relay coil is coupled through a switch to a source of dc coil voltage and is also connected to ground. A triac has its first and second main electrodes coupled in parallel to the pair of contacts of the electromechanical relay between the ac source and the load. A capacitor has one lead connected to the first lead of the relay coil and a second lead connected to the gate of the triac. On application of power to the coil, the capacitor charges through the triac, mining it on prior to the coil voltage of the relay reaching its design pick-up voltage. Then during switch dormancy, the coil-energized relay contacts carry the load. Likewise, upon opening of the switch, the capacitor supplies gating current to the gate of the triac device prior to opening of the relay contacts. The make or break current is carried by the triac, but the steady state current is carried by the relay contacts. The capacitor can be optically coupled to and electrically isolated from the triac device, through a bi-directional LED arrangement, and either a phototransistor pilot stage or a phototriac.

13 Claims, 5 Drawing Sheets

SOLID STATE/ELECTROMECHANICAL HYBRID RELAY

BACKGROUND OF THE INVENTION

The present invention relates to high current switching devices such as relays or contactors, that is, devices in which the appearance of a pilot current or voltage causes the opening or closing of a controlled switching device. Typically, relays are either of the electromechanical type or the solid state type. This invention is more particularly concerned with a hybrid or combination solid state/electromechanical relay circuit which combines the advantageous features of solid state and electromechanical relays but avoids their disadvantageous features.

Electromechanical relays are electromagnetic devices in which current flowing through a coil actuates (i.e., doses or opens) a pair of electrical contacts. This can occur in a number of well known ways, but usually an iron armature is magnetically deflected towards a soft iron core of the coil to make (or break) the controlled circuit. In electromechanical relays, the voltage drop across the switching or output contacts is low, i.e., on the order of millivolts, so there is an extremely low power loss in comparison with solid state switches or solid state relays. These conventional electromechanical devices are considered to be non-dissipating.

Solid state relays have all solid state components, and do not require any moving parts. Switching is carried out using a power semiconductor device capable of handling high voltages and large currents. Such devices can be thyristors or other transistor devices, including MOSFET transistors, IGBTs, SCRs, or SIDACs. For control of an ac circuit, a triac is often used. Isolation between output and input terminals can be achieved by magnetic coupling or with an opto-isolator, which can comprise a light-emitting diode (LED) in conjunction with a photodetector device such as a phototransistor. For many purposes, a phototriac or other photothyristor device can be used. In the case of opto couplers, a light source coupled to a photo-sensitive receiver is one possible form. Another possibility is the use of a light source coupled to a photo-generator which acts as a source. Magnetic pulse transformers can serve as isolation means, either instead of an opto isolator or in conjunction with it.

Solid state relays have some clear advantages over electromechanical relays, such as increased lifetime, clean, bounceless operation, decreased electrical noise, compatibility with digital circuitry, and resistance to corrosion. However, there are disadvantages, as well, including the need to dissipate the substantial amount of heat that is generated whenever the load current exceeds several amperes. The triac typically has a forward voltage between one and two volts, and this produces a power loss (in the form of heat) of one to two watts for each ampere of current. In many cases, this necessitates some means for cooling the device. Also, power consumed in the triac represents wasted power, and thus inefficient operation.

Electromechanical devices, which rely on a pair of contacts, a mercury switch, or similar metallic connector, have a near-zero-ohm impedance when closed. Consequently, these devices can be used to control quite high currents without difficulty. However, because there is a physical closure of contacts required, arcing usually occurs when the relay is actuated. This produces switching noise, at a minimum, and will also produce pitting and erosion of the contacts. Arcing occurs on both make and break, but is an especial problem on break when the controlled load is an reactive device, such as an ac motor.

Heat actuated relays can be used rather than electromagnetic relays for some applications. In these relays a pilot switch actuates a resistive heater, which causes a bimetal strip to bend and make or break contact. These are simpler and less expensive than electromagnetic relays, but are much slower to react and still have the problems of pitting and erosion of the contacts.

In solid state switching devices, the forward voltage drop may be considerably higher than in an elecromechanical device, causing substantial power loss for high load currents. On the other hand, electomechanical devices have significantly limited life capabilities, whereas solid state devices provide an almost infinite life span. Additionally, a solid state switch is a quiescent device, such that during switching no arcing occurs, whereas electromechanical switches draw a substantial are, particularly when controlling reactive loads.

While the ability of solid state switching to avoid arcing is well known, it has not been previously proposed to protect an electromechanical switch contact during actuation and during the subsequent disconnect, while at the same time to take advantage of the non-dissipative characteristic of electromechanical relays, contactors, and similar switching devices.

OBJECTS AND SUMMARY OF THE INVENTION

It is an object of this invention to provide a hybrid solid-state and electromechanical relay that avoids the drawbacks of solid state relays and of electromechanical relays.

It is another object to provide a hybrid solid state relay which has a substantially zero steady-state voltage drop in the contacts in series with the load, but does not exhibit bounce, switch noise, or arcing.

It is a further object to provide a hybrid relay that is reliable and enjoys long life.

It is a still further object to provide a hybrid relay which isolates the pilot voltage or current from the power to the load device.

According to an aspect of the invention, a solid-state/electromechanical hybrid relay connects an ac power source to a load. A switch terminal connects through a switch to a source of pilot voltage. An electromechanical relay includes a coil and a pair of contacts which close in response to energization of the relay coil; this pair of contacts being coupled between the load and the ac source, with the coil having a first lead coupled through the switch to a source of dc coil voltage and the second lead being connected to a common reference point. A triac device has a gate electrode and first and second main electrodes coupled in parallel to the pair of contacts of the electromechanical relay between the ac source and the load. A capacitor has one lead connected to the first lead of the relay coil and a second lead connected to the gate of the triac device. Closure of the switch supplies gating current through the capacitor to the triac device and gates the triac device on prior to closure of the contacts. That is, on application of power to the coil, the capacitor charges through the triac, taming it on prior to the coil voltage of the relay reaching its design pick-up voltage. Then during switch dormancy, the coil-energized relay contacts carry the load. Likewise, upon opening of the switch, the capacitor supplies gating current to the gate of the triac device prior to opening of the relay contacts. This gates the triac device on and holds it on for a brief interval after the opening of said relay contacts. That is, the make or break current is carried by the triac, but the steady state current is carried by the relay contacts. The triac device powers the load device without switch noise, chatter, or arcing. When the electromechanical relay closes the contacts, and later when the contacts open, there is only a small voltage (one to two volts) between the contacts, and this condition avoids arcing, and also avoids the concomitant pitting and erosion of the contact material. Closure of the relay contacts commutes the triac device off. In normal operation current for charging the capacitor flows to the gate of the triac only during the brief intervals just before and after electromechanical contact closure or opening. This limits the current through the main triac electrodes only to the brief intervals around contact opening and closure.

In some embodiments, the capacitor can be coupled directly to the gate of a power triac or to the gate of a pilot triac connected in cascade with the power triac. In other embodiments, the capacitor can be optically coupled to and electrically isolated from the triac device, through a bi-directional LED arrangement, and either a phototransistor pilot stage or a phototriac.

The hybrid solid-state/electromechanical relay is of a simple, straightforward design. The circuit is inherently compact, but also avoids the requirement for cooling or other protective equipment which as mentioned above is needed for high-power solid state relays and contactors.

The above and many other objects, features, and advantages of this invention will become apparent from the ensuing description of a preferred embodiment, which should be read in conjunction with the accompanying Drawing.

DETAILED DESCRIPTION OF THE PREFERRED EMBODIMENTS

Figure 1:
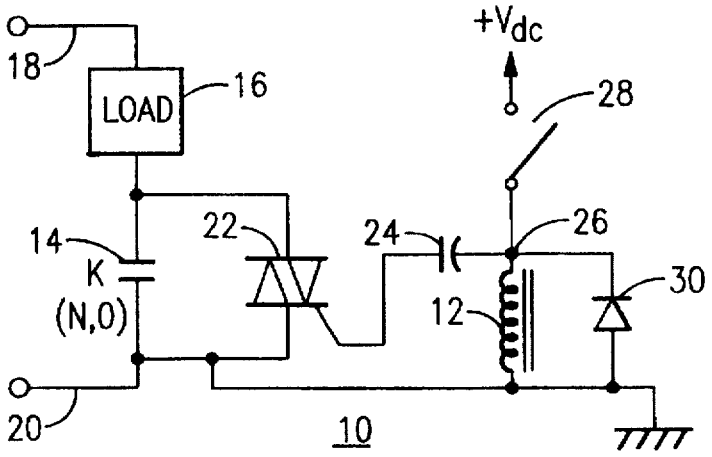
FIG. 1 is a circuit diagram for a hybrid solid state/electromechanical relay according to one possible embodiment of the present invention.

With reference to the Drawing, FIG. 1 is a circuit diagram of an illustrative embodiment of a hybrid solid state/electromechanical relay 10. The operation of this relay 10 will be explained below with reference to FIGS. 2 and 3.

The hybrid relay 10 includes an electromechanical relay that is formed of a coil 12 and an associated pair of contacts 14. The contacts 14 can be of the armature type, in which one of the contacts is magnetically deflected by the coil, but could also be of another type, such as a reed switch or mercury switch. The contacts 14 are connected in series with a load device 16, between first and second ac power inputs 18 and 20. In this example, the contacts 14 are of the normally-open type, that is, the contacts 14 are pulled closed when current flows through the coil 12. However, the invention performs equally well if the relay contacts are of the normally-closed type. The type of load device 16 is not critical to the invention, but the hybrid relay of this type finds excellent application for high current draw, inductive loads, such as heavy duty ac induction motors.

In this embodiment, a triac 22 is connected with its cathode and anode, or first and second main terminals, in parallel with the relay contacts 14 between the load device 16 and the power input 20. A capacitor 24 is coupled between a switch terminal lead 26 of the coil 12 and the gate terminal of the triac 22. A switch device 28 connects the switch terminal lead 26 to a source of dc voltage+$V_{dc}$ and the opposite lead of the coil 12 is connected to a reference point, here dc ground. The cathode of the triac 22 is also brought to dc ground, and a flyback protective diode 30 is shown connected in parallel with the coil 12.

The action of this hybrid relay 10 on actuation, i.e., on make or break, can be explained with reference to FIGS. 2 and 3.

Figure 2:
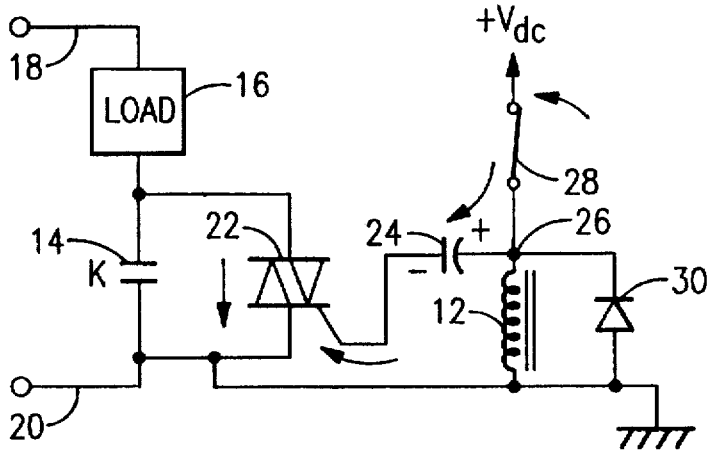
FIGS. 2 and 3 are circuit diagrams of the embodiment of FIG. 1 for explaining operation at dosing and opening.

As shown in FIG. 2, when the switch 28 is closed, the dc voltage+$V_{dc}$ is applied to the coil 12 and also to the capacitor 24. As current begins to flow to the coil, the capacitor also charges up, and current flows therefrom into the gate terminal of the triac 22. The capacitor 24 ramps the voltage at the switch terminal lead 26, and the triac goes into conduction before the voltage to the coil 12 is great enough to actuate the contacts 14. The current through the load is initially carried by the triac 22. Then after a brief interval, the coil 12 closes the contacts 14. The contacts 14 short-circuit the triac 22. The voltage on the capacitor 24 exceeds the threshold pickup voltage of the coil 12. Thus, steady-state load current is carried by the non-dissipative electromechanical switch. As long as the switch 28 resides in the closed condition, the relay contacts 14 carry the load current, and the capacitor 24 remains charged up, disallowing gating current to the triac gate.

Figure 3:
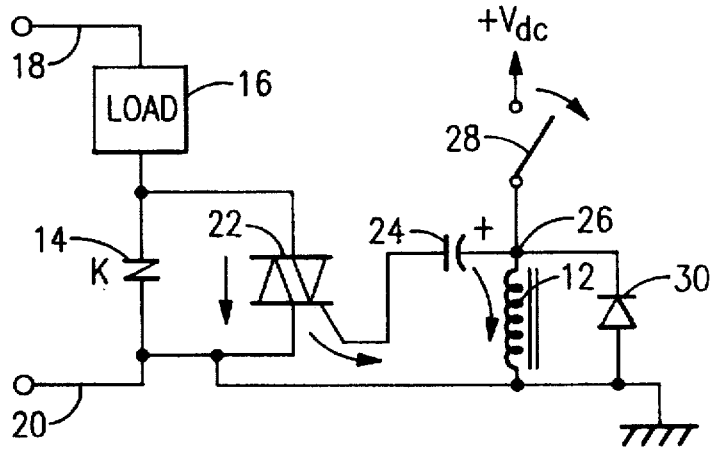

When the switch 28 is moved to the open condition, as shown in FIG. 3, the dc voltage $V_{dc}$ is cut off from the switch terminal lead 26 to the coil 12. However, the capacitor 24, being fully charged, discharges through the coil 12, and again produces a gate current in the gate terminal of the triac 22. This causes the triac 22 to conduct before the relay contacts 14 open. A brief interval thereafter, when the capacitor 24 has discharged, and after the contacts 14 have opened, the gating current disappears, and the triac commutates off.

Figure 4:
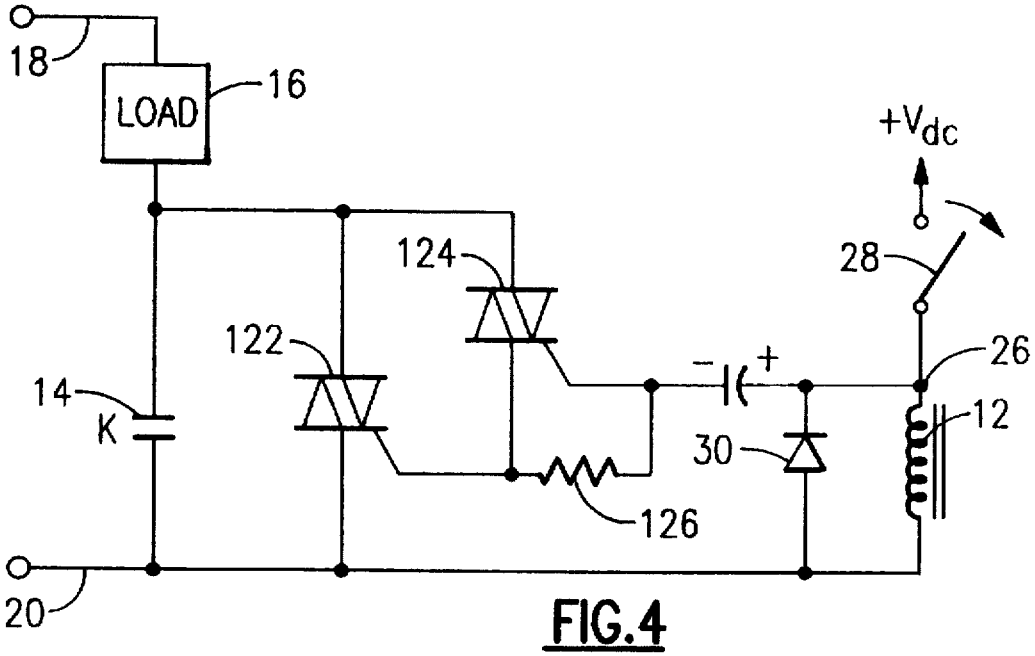
FIG. 4 is a circuit diagram of another embodiment of the invention.

Another embodiment of the hybrid relay of the present invention is shown in FIG. 4. Elements that are identical with those of the FIG. 1 embodiment are identified with the same reference characters, and a detailed description thereof will not be repeated. Here, rather than the single triac 22 of the first embodiment, this circuit employs a power triac 122 and a pilot duty triac 124 connected in cascade. The anodes or second main terminals of the triacs 122 and 124 are connected together and the gate of the power triac 122 is connected to the cathode or first main terminal of the pilot duty triac 124. The gate terminal of the pilot duty triac 124 is coupled to the capacitor 24, and a resistor 126 is connected between the gate and cathode terminals of the triac 124. The power triac has its anode and cathode connected in parallel with the electromechanical relay contacts 14 between the load 16 and the ac power terminal 20.

Figure 5:
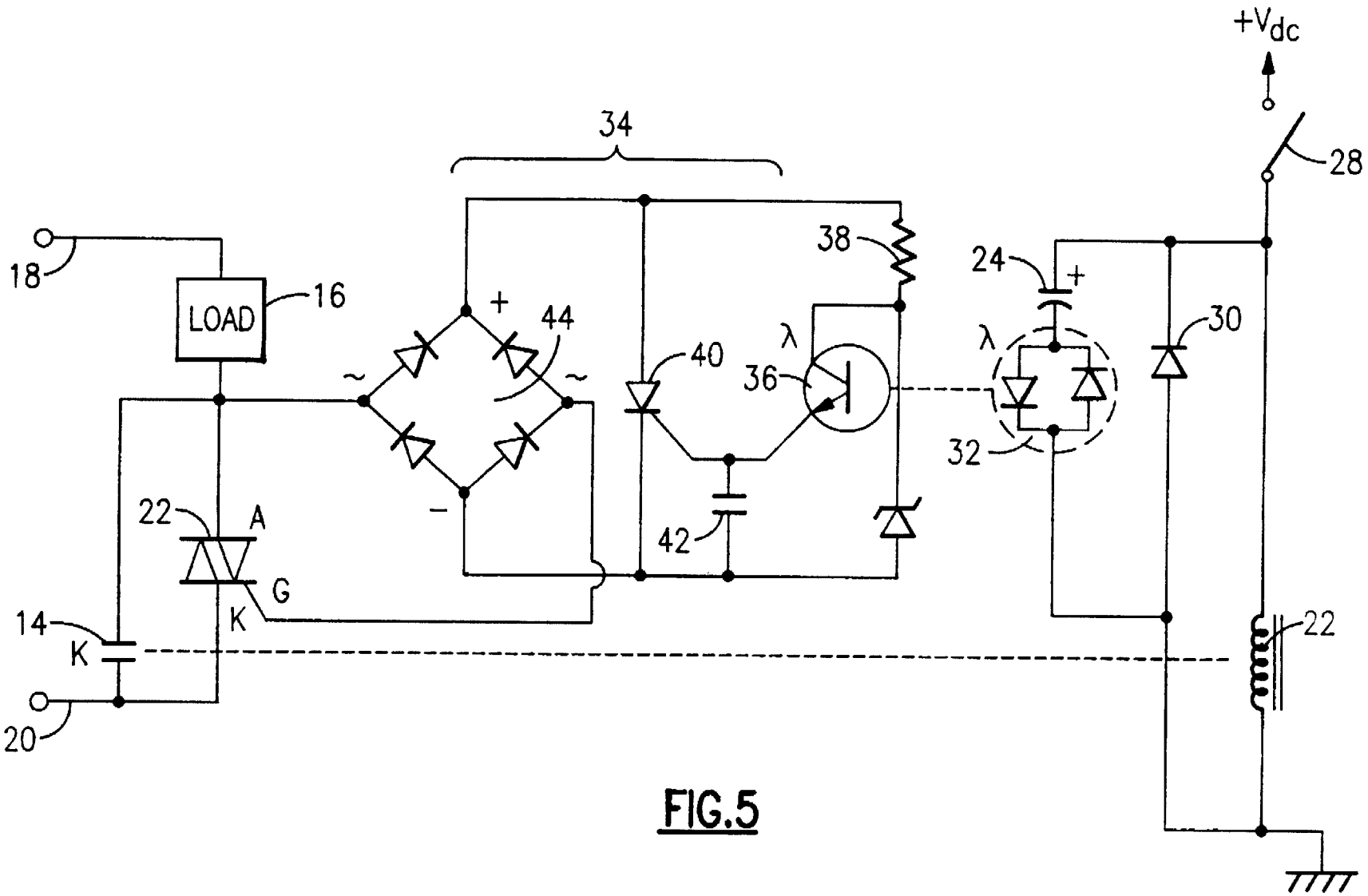
FIG. 5 is a circuit diagram of an embodiment of this invention that features electrooptical isolation between stages.

A third embodiment is shown in FIG. 5, and this embodiment features optical coupling and electrical isolation between the dc pilot stage and the ac power stage. Again, elements that correspond to similar elements of the previously described embodiments are identified with the same reference characters, and a detailed description will not be repeated.

In this embodiment, the capacitor 24 is not connected electrically to the triac 22. Rather, the capacitor is connected in series with a bidirectional light emitting (LED) device 32, and the series circuit formed of the capacitor 24 and LED device 32 is connected in parallel with the relay coil 12, between the switch terminal lead 26 and ground. In this device 32, there is a pair of LEDs connected in anti-parallel, but both in a single package. This device is intended to illuminate both on forward current (when the switch 28 closes and the capacitor 24 charges) and on reverse current (when the switch 28 opens and the capacitor 24 discharges).

The LED device 32 is optically coupled to a photodetector stage 34 that is in turn electrically coupled to the gate terminal of the triac 22. Here, a phototransistor 36 has its collector coupled to a bias network 38, and has its emitter connected to the gate terminal of a silicon controlled rectifier or SCR 40. A small capacitor 42 is coupled between the gate and cathode terminals of the SCR 40. A diode bridge 44 has a pair of ac ports connected respectively to the gate terminal and the anode terminal or main terminal 2 of the triac 22, and has a pair of dc ports connected respectively to the anode and cathode of the SCR 40.

When the switch 28 is closed, the capacitor 24 charges up, as discussed previously, and current flows through the LED device 32 to illuminate the phototransistor 36. The latter then gates the SCR 40, which brings gating current through the bridge 44 to the gate terminal of the triac 22. As with the previous embodiments, the triac 22 conducts before the coil 12 can close the contacts 14. Shortly thereafter, the coil pickup voltage is reached, the capacitor 24 becomes fully charged and the LED device goes dark. This turns off the photodetector stage 34, and the triac 22 commutates off. When the switch 28 is opened, the capacitor 24 discharges through the coil 12, and current again flows (in the other direction) through the LED device 32. This actuates the triac 22 in the same fashion as discussed just above prior to opening of the relay contacts. After the charge on the capacitor 24 is decayed, the LED device goes dark and the photodetector circuit 34 allows the triac to turn off. As with the previously discussed embodiments, the triac carries the make and break current, but the electromechanical relay contacts 14 carry the steady state load current.

Figure 6:
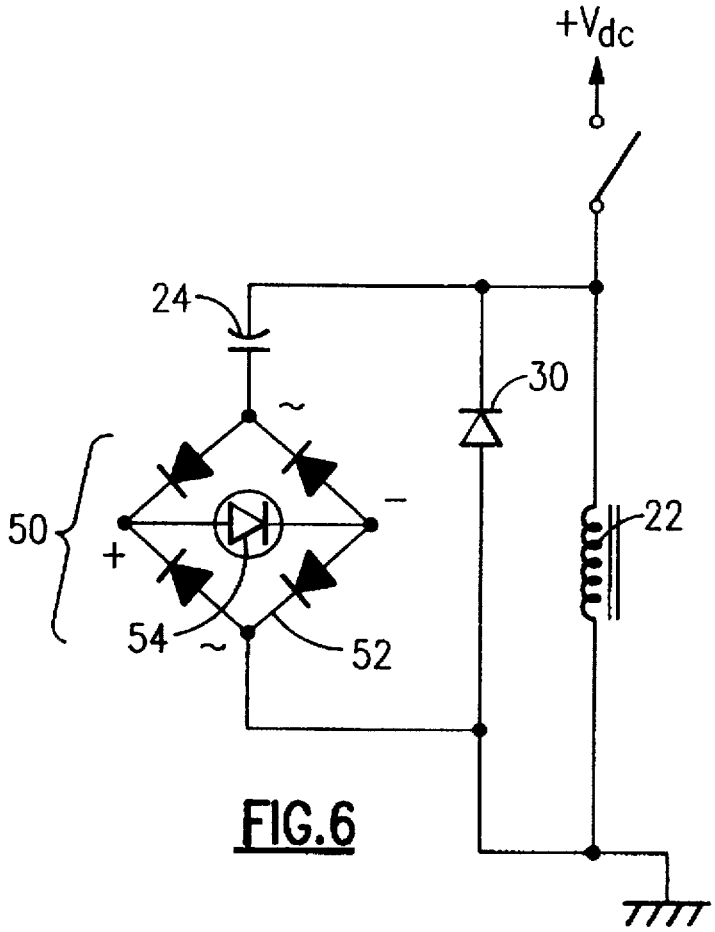
FIG. 6 is a circuit diagram of a variation of a portion of the embodiment of FIG. 5.

FIG. 6 shows an alternative arrangement of the dc pilot stage which can be used in place of the circuit arrangement shown at the right-hand side of FIG. 5. Here the capacitor 24 is coupled in series with an LED-diode bridge arrangement 50, which replaces the bidirectional LED device 32 of FIG. 5. In this arrangement 50 a diode bridge 52 has one ac port connected to the capacitor 24 and its other ac port connected to ground and to the ground lead of the relay coil 12. An LED 54 has its anode connected to the positive dc port of the bridge 52 and has its cathode connected to the negative port of the bridge. With this arrangement, current flows through the unidirectional LED 52 both when the capacitor 24 is charging and when it is discharging. The single LED 54 and the phototransistor 36 can be incorporated into a single package, e.g., an opto-isolator.

Figure 7:
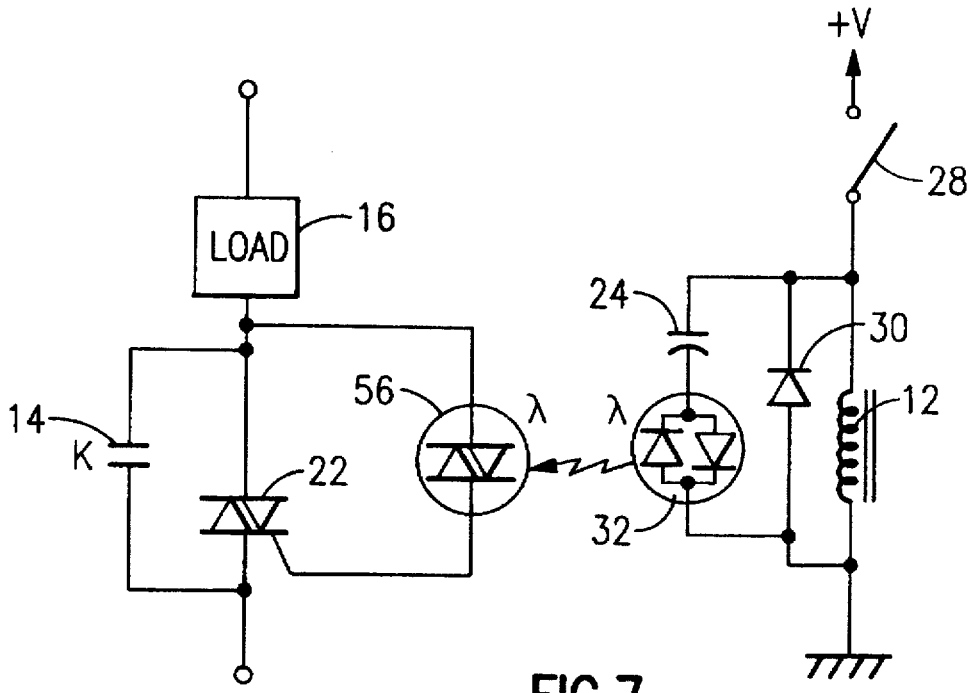
FIGS. 7, 8, 9 and 10 are circuit diagrams of further embodiments of the invention.

Still another possible embodiment of the hybrid relay of this invention is shown in FIG. 7, in which elements introduced earlier in respect to the FIG. 5 embodiment are identified with the same reference characters. This is another example of a circuit in which the ac and dc stages are coupled optically, but isolated electrically. The coil 12, capacitor 24, and bidirectional LED 32 operate as discussed above. However, in this embodiment a phototriac 56 is optically coupled to the LED device 32, and has its anode or main terminal 2 connected to corresponding electrode of the power triac 22 and its cathode or main terminal connected to the gate terminal of the power triac 22. The power triac 22 and phototriac 56 can be combined into a single package, that is, a photodarlington triac. Also, for an appropriate circuit application, the phototriac 60 can be used as the solid state relay, replacing the power triac 22 entirely.

Figure 8:
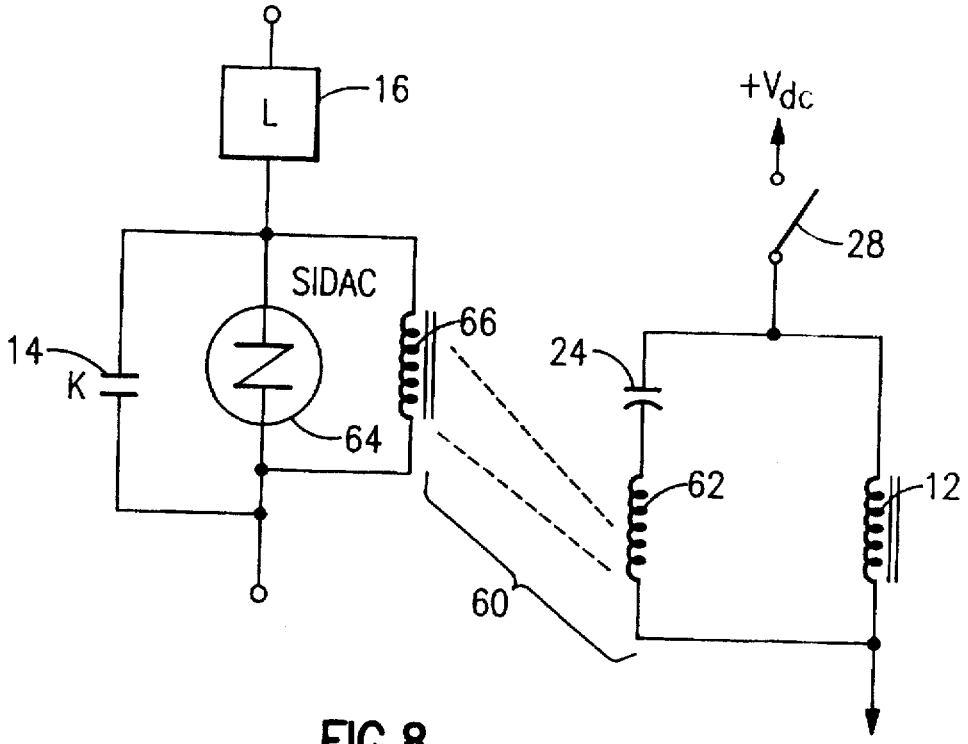
Figure 9:
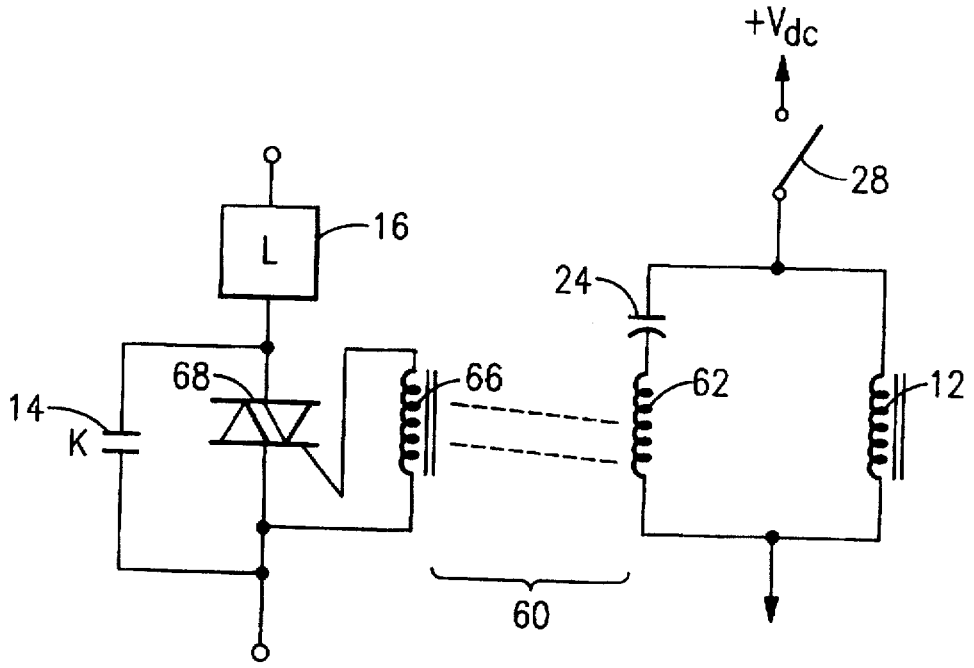

FIGS. 8 and 9 illustrate further possible embodiments that employ magnetic coupling to achieve isolation between the pilot and power stages. In FIG. 8, a pulse transformer 60 has a primary coil 62 coupled in series between the capacitor 24 and one end of the relay coil 12. Here a SIDAC 64, i.e., a two-wire solid state switching device is employed in series with the load 16 and in parallel with the relay contacts 14. This SIDAC device 64 is configured to turn on whenever a high breakover voltage appears between its two terminals. The secondary 66 of the pulse transformer 60 is coupled across the SIDAC 62. The turns ratio of the pulse transformer 60 is selected to achieve breakover voltage whenever the switch 28 is opened or closed. Not shown are diodes and internal impedances in the secondary coil 66 to block load current from the secondary coil 66. Here, both the main and pilot power can be ac.

Figure 10:
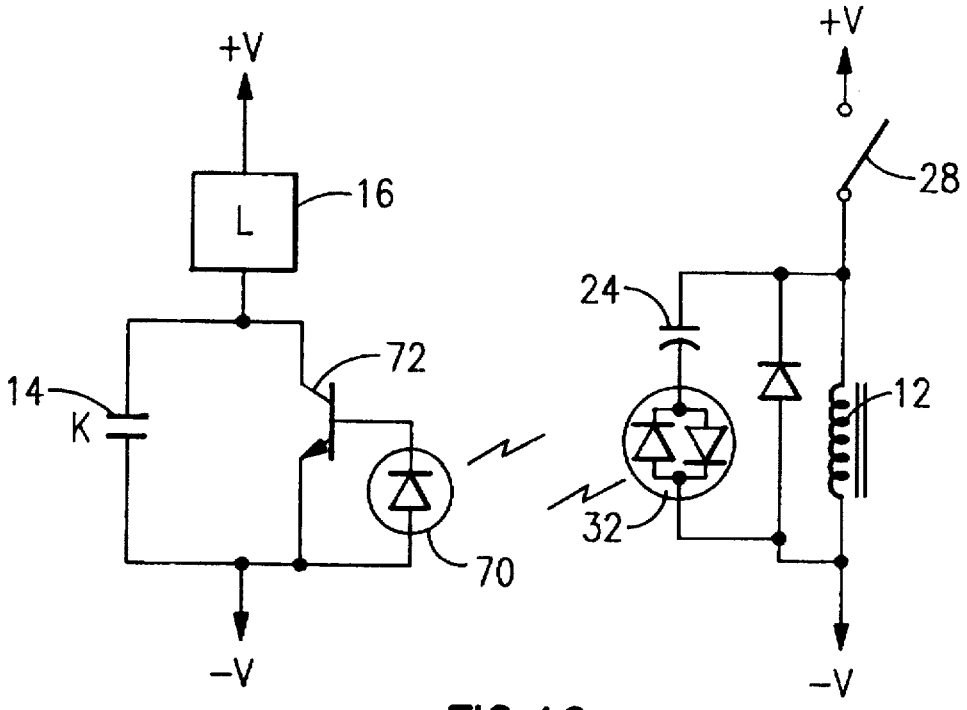

FIG. 9 shows a similar configuration, except that a triac 68 is used instead of the SIDAC. Here, the secondary coil 66 of the pulse transformer 60 is coupled between the gate and the cathode of the triac 68.

Where the main power for the load is dc, a dc transistor switching arrangement can be employed, as shown in FIG. 10. In this case the pilot stage can be connected e.g. as shown previously in FIGS. 5 and 7, with a bidirectional LED device 32 in series with the capacitor 24. The device 32 is optically coupled to a photosensor 70. Here the power stage comprises a transistor 72 having its collector tied to the load device and its emitter tied to the negative dc voltage –V. The photosensor 70 biases the emitter-base junction of transistor 72 whenever the switch 28 opens or closes. Here an NPN junction transistor is shown as an example. However, another transistor switch could be employed instead, such as a MOSFET or an SCR. The principles of this invention can be applied to ac or dc coils and relays, with the load applied to either the high or low side.

While the invention has been described in detail with reference to certain preferred embodiments, it should be understood that the invention is not limited to those precise embodiments. Rather, many modifications and variations would present themselves to persons skilled in the art without departure from the scope and spirit of the invention, as defined in the appended claims.

I claim:

1. Solid-state/electromechanical hybrid relay for connecting a power source to a load, comprising an electromechanical relay which includes a coil and a pair of contacts which close in response to energization of said coil, said pair of contacts being coupled between said load and said power source, said coil having a first, switch terminal lead which is coupled through a switch to a source of coil voltage and a second lead which is connected to a common reference point;

a solid state switching device having first and second main electrodes coupled in parallel to the pair of contacts of said relay between said power source and said load, and a gate;

a capacitor having one lead connected to the first lead of said relay coil and a second lead connected to the gate of said solid state switching device;

such that closure of said switch supplies a momentary gating current through said capacitor to said solid state switching device to gate said solid state switching device on prior to closure of the contacts, and opening of said switch permits said capacitor to supply a momentary gating current to the gate of said solid state switching device prior to opening of said contacts and hold the solid state switching device on for a brief interval after the opening of said relay contacts.

2. The hybrid relay of claim 1 wherein said solid state switching device includes a triac device.

3. The hybrid relay of claim 2 wherein said triac device includes a power triac having first and second main electrodes and a gate, and a pilot triac having first and second main electrodes connected between the gate and second main electrode of said power triac, and a gate coupled to said capacitor.

4. The hybrid relay of claim 1 further comprising a flyback protection diode connected in parallel to said coil.

5. Solid-state/electromechanical hybrid relay for connecting a power source to a load, comprising an electromechanical relay which includes a coil and a pair of contacts which close in response to energization of said coil, said pair of contacts being coupled between said load and said power source;

said coil having a first lead coupled through a switch to a source of coil voltage and a second lead connected to a common reference;

a solid state switching device having first and second main electrodes coupled in parallel to the pair of contacts of said relay between said power source and said load, and a gate;

a capacitor and a photoemitter connected in series between the first and second leads of said coil;

a photodetector device optically coupled to said photoemitter and having an output that is coupled to the gate of said solid state switching device, such that closure of said switch causes said capacitor to charge through said photoemitter and opening of said switch means causes said capacitor to discharge through said photoemitter such that on opening and closing of said switch gating current appears momentarily on the gate of said solid state switching device and that the solid state switching device is conducting at the times that the relay contacts close or open, but remains off otherwise.

6. The hybrid relay of claim 5 wherein said solid state switching device includes a triac device.

7. The hybrid relay of claim 6 wherein said photodetector device includes a phototransistor optically coupled to said photoemitter and having an output electrode, and an SCR bridge comprising a diode bridge having four ports, with two of said ports being coupled respectively to the second main electrode and the gate of said triac device, and an SCR having an anode and a cathode respectively coupled to the other two ports of said diode bridge and a gate coupled to the output electrode of said phototransistor.

8. The hybrid relay of claim 5 wherein said photoemitter includes a pair of LEDs connected in antiparallel.

9. The hybrid relay of claim 5 wherein said photoemitter includes a diode bridge having a pair of ac inputs connected respectively to said capacitor and to one of the leads of said coil, and positive and negative dc outputs; and an LED having an anode and a cathode respectively coupled to said dc outputs.

10. The hybrid relay of claim 5 wherein said photodetector includes a phototriac having a pair of main electrodes, and being optically coupled to said photoemitter, said main electrodes being respectively coupled to the second main electrode and gate of said solid state switching device.

11. Solid-state/electromechanical hybrid relay for connecting an ac power source to a load, comprising an electromechanical relay which includes a coil and a pair of contacts which close in response to energization of said coil, said pair of contacts being coupled between said load and said ac source;

said coil having a first lead coupled through a switch to a source of coil voltage and a second lead connected to a common reference;

a phototriac device having first and second main electrodes coupled in parallel to the pair of contacts of said relay between said ac source and said load;

a capacitor and a photoemitter connected in series between the first and second leads of said coil;

said phototriac device being optically coupled to said photoemitter, such that closure of said switch causes said capacitor to charge through said photoemitter and opening of said switch causes said capacitor to discharge through said photoemitter such that upon opening and closing of said switch said phototriac device is gated on and that the phototriac device is momentarily conducting at the times that the relay contacts close or open.

12. Solid-State/electromechanical hybrid relay for connecting an ac power source to a load, comprising an electromechanical relay which includes a relay coil and a pair of contacts which close in response to energization of said coil, said pair of contacts being coupled between said load and said ac source;

said relay coil having a first lead coupled through a switch to a source of coil voltage and a second lead connected to a common reference;

a SIDAC device having first and second electrodes coupled in parallel to the pair of contacts of said relay between said ac source and said load;

a capacitor and a primary coil of a pulse transformer connected in series between the first and second leads of said relay coil; and a secondary coil of said pulse transformer being coupled across the first and second electrodes of said SIDAC device, and actuating said SIDAC on momentarily when said switch is closed and when the latter is opened.

13. Solid-state/electromechanical hybrid relay for connecting an ac power source to a load, comprising an electromechanical relay which includes a relay coil and a pair of contacts which close in response to energization of said coil, said pair of contacts being coupled between said load and said ac source;

said relay coil having a first lead coupled through a switch to a source of coil voltage and a second lead connected to a common reference;

a triac device having a gate electrode and having first and second electrodes coupled in parallel to the pair of contacts of said relay between said ac source and said load;

a capacitor and a primary coil of a pulse transformer connected in series between the first and second leads of said relay coil; and a secondary coil of said pulse transformer being coupled to the gate electrode and to one of the first and second electrodes of said triac device.

* * * * *

UNITED STATES PATENT AND TRADEMARK OFFICE

CERTIFICATE OF CORRECTION

PATENT NO. : 5,699,218

DATED : December 16, 1997

INVENTOR(S) : Kadah

It is certified that error appears in the above-identified patent and that said Letters Patent is hereby corrected as shown below:

TITLE PAGE

In section *Attorney, Agent or Firm*, please change "Nolldrem" to read --Molldrem--.

ABSTRACT

Line 15, please change "mining" to read --turning--.

Column 1, line 17, please change "doses" to read --closes--.

Column 2, line 16, please change "are" to read --arc--.

Signed and Sealed this

Fourteenth Day of April, 1998

Bruce Lehman

*Attest:*

BRUCE LEHMAN

*Attesting Officer*

*Commissioner of Patents and Trademarks*